US005315784A

United States Patent [19]

Henehan

[11] Patent Number: 5,315,784

[45] Date of Patent: May 31, 1994

[54] DEVICE FOR ROTATING HANGING PLANT AND INDICATING DRYNESS

[76] Inventor: William M. Henehan, 2233 Village Green Pkwy., Chesterfield, Mo. 63017

[21] Appl. No.: 973,623

[22] Filed: Nov. 9, 1992

[51] Int. Cl.[5] ..... A01G 9/02; A47G 7/02

[52] U.S. Cl. ..... 47/67; 248/333

[58] Field of Search ..... 47/67, 39; 248/318, 248/326, 330.1, 333

[56] References Cited

U.S. PATENT DOCUMENTS

| | | | |
|---|---|---|---|
| 1,367,972 | 2/1921 | Hyde . | |
| 2,951,673 | 9/1960 | Critcher . | |
| 3,967,578 | 7/1976 | Gallo . | |
| 4,078,625 | 3/1978 | Loeb | 47/39 |
| 4,189,124 | 2/1980 | Faris | 47/67 |
| 4,216,619 | 8/1980 | Espy | 47/67 |
| 4,227,343 | 10/1980 | Espy et al. | 47/67 |
| 4,446,653 | 5/1984 | Morgan, Jr. | 47/67 |
| 4,454,831 | 6/1984 | Gallo | 47/67 |
| 4,480,465 | 11/1984 | Chase . | |
| 4,760,666 | 8/1988 | Han . | |
| 4,825,591 | 5/1989 | Han . | |
| 5,079,869 | 1/1992 | Dawson . | |

*Primary Examiner*—Ramon S. Britts
*Assistant Examiner*—Joanne C. Downs
*Attorney, Agent, or Firm*—Grace J. Fishel

[57] ABSTRACT

A device for rotating a hanging plant to keep it from growing lopsided. The device has counteracting coaxial tension springs of opposite hand that rotate the plant first in one direction when the plant is watered and then in the opposite direction as the plant goes from wet to dry. A weight change of 10–20% is sufficient to rotate the plant at least ½ turn. An indicator is responsive to changes in the length of the springs as the plant dries out and as the springs are axially unloaded.

7 Claims, 3 Drawing Sheets

DEVICE FOR ROTATING HANGING PLANT AND INDICATING DRYNESS

The present invention relates to a device for rotating a hanging plant as moisture evaporates from the plant and for visually indicating when the plant is dried out.

BACKGROUND OF THE INVENTION

It is well known that plants tend to bend towards the light so that a plant must be rotated frequently or it will grow lopsided. It is also well known that a plant's water requirements change with the growing season and with ambient temperature and relative humidity. Optimally, the plant should be rotated more frequently than it is watered. A fixed once or twice-a-week plant rotation and watering program is not conducive to best plant growth but it is better, in most cases, than waiting for them to droop.

Hanging plants are popular because they take up very little living space. Hanging plants are frequently under rotated and over or under watered because they are difficult to reach. Because of these difficulties, there have been a number of spring loaded devices proposed for indicating that a hanging plant has dried out. There is also one patent (U.S. Pat. No. 4,216,619 to Espy) which discloses a spring loaded device for rotating a plant as well as for indicating dryness. In the later case, axial deflection of a helically coiled spring is converted into linear motion by means of a spiral shaft. Friction among the working parts has kept the device from having practical utility.

SUMMARY OF THE INVENTION

An important object of the present invention is to provide a device for rotating a hanging plant. The device makes use of counteracting coaxial tension springs of opposite hand that, with minimal frictional losses, rotate the plant as the plant goes from wet to dry. The device optionally includes a visual indicator for signaling that the plant is dry. Other objects and features of the invention will be in part apparent and in part pointed out hereinafter.

In accordance with the invention, a device for rotating a hanging plant has a first tension spring with a longitudinal coil axis. One end of the first tension spring is fixed and the other end is free to rotate about the coil axis when the spring is axially loaded. The fixed end of the first tension spring is attached to a first support for suspension from an overhead surface while the free end is attached to a second support for suspension of a hanging plant.

A second tension spring counteracting the first tension spring is coaxial with the first spring but of opposite hand. The first end of the second spring is attached to the first support and the second end of the second spring is attached to the second support. The first and second springs are formed of material such that the second spring is twisted around the coil axis by the first spring when the springs are axially loaded with a wet plant. As the plant dries and the springs are axially unloaded, the first spring is twisted about the coil axis in an opposite direction by the second spring and in consequence the plant is rotated.

The invention summarized above comprises the constructions hereinafter described, the scope of the invention being indicated by the subjoined claims.

BRIEF DESCRIPTION OF THE DRAWINGS

In the accompanying drawings, in which several of various possible embodiments of the invention are illustrated.

DETAILED DESCRIPTION OF THE INVENTION

Figure 1:
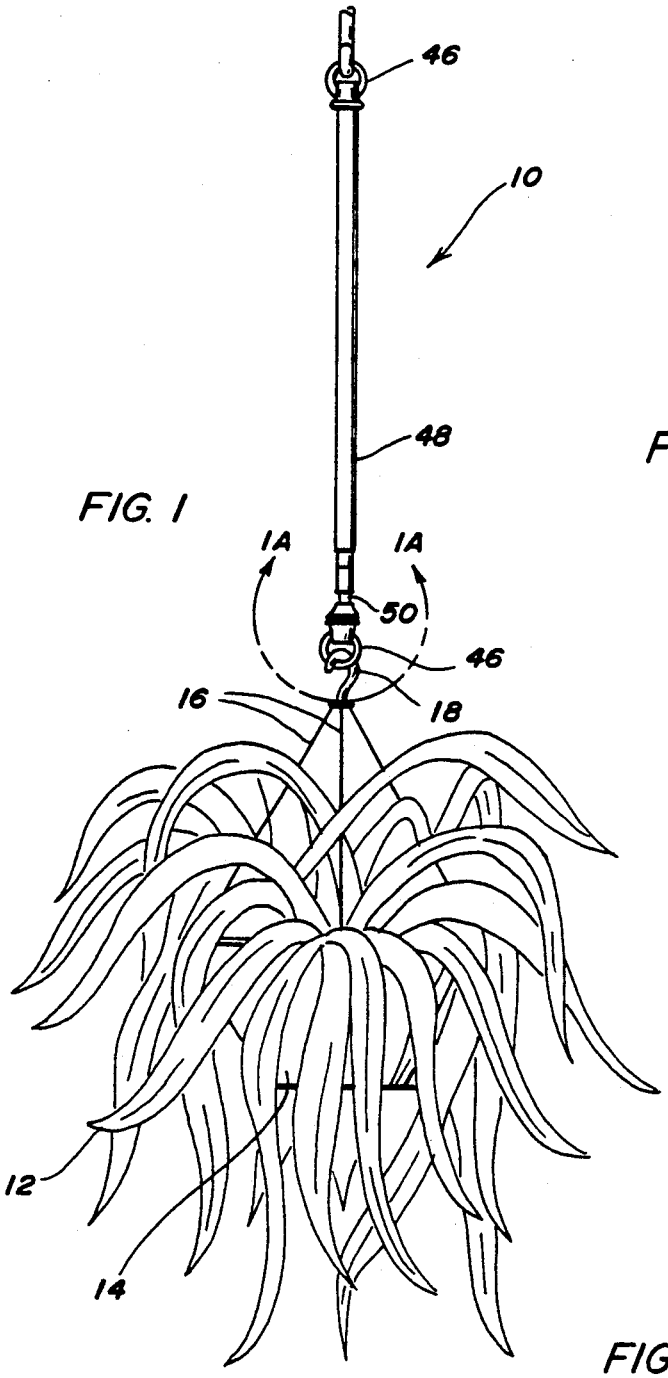
FIG. 1 is an elevation of a device for rotating a hanging plant and indicating dryness in accordance with the present invention.
Figure 1A:
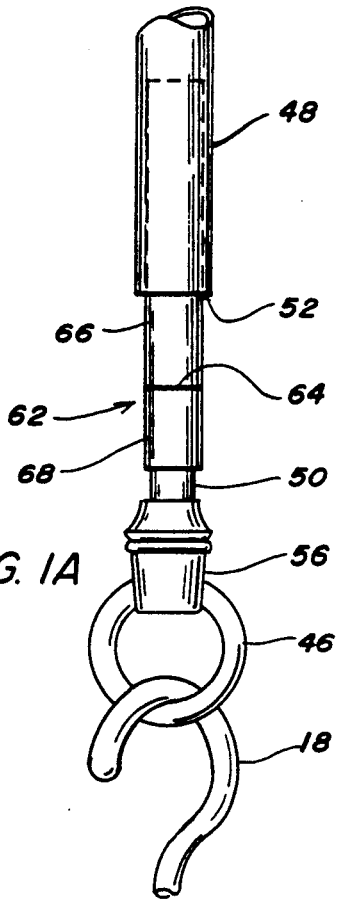
FIG. 1A is a detail taken along line 1A—1A in FIG. 1 showing the device after the plant has been watered.
Figure 1B:
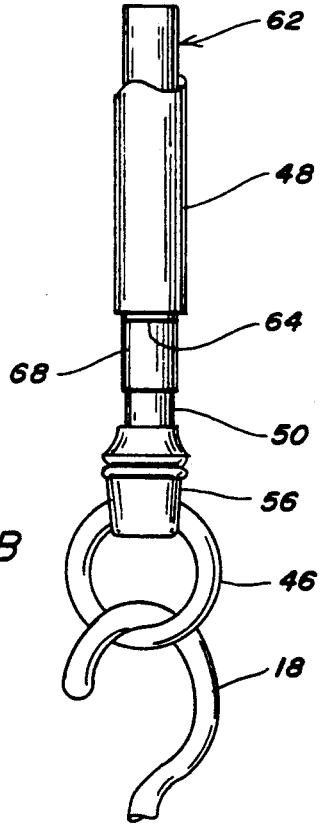
FIG. 1B is like FIG. 1A after some of the moisture has evaporated from the plant.

Referring to the drawings more particularly by reference character, reference numeral 10 refers to a device for rotating a hanging plant 12 in accordance with the present invention. Plant 12 is contained in a carrying device such as a pot or container 14 that is in turn supported by lines 16 connected to a hook 18.

Figure 2:
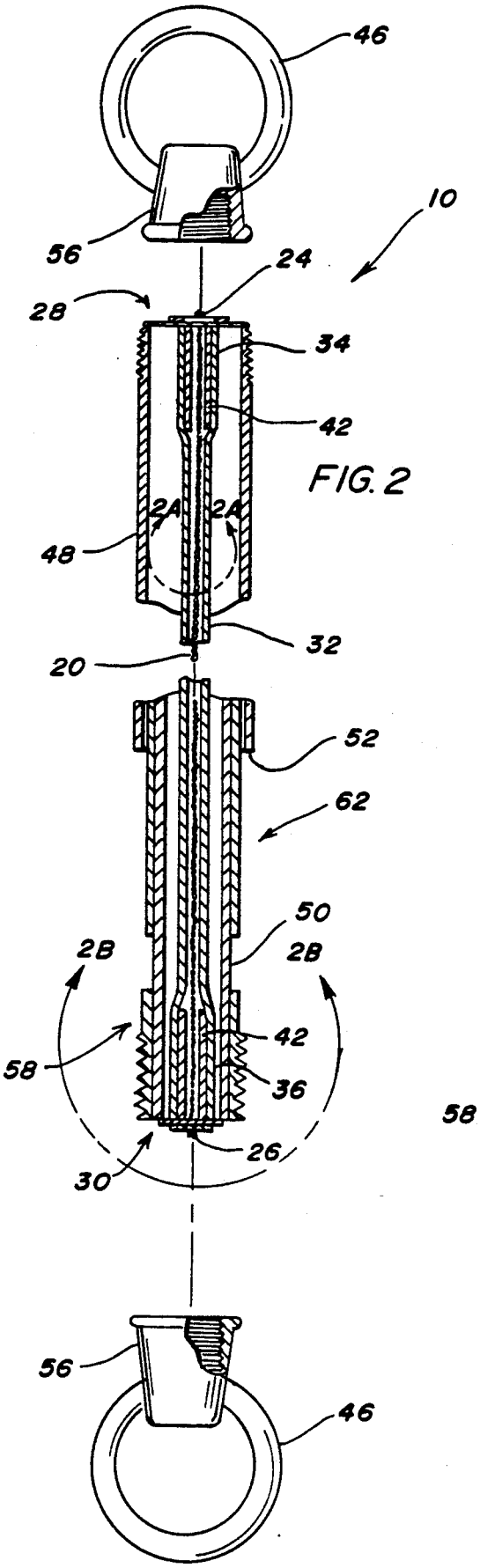
FIG. 2 is an enlarged sectional view of the device.
Figure 2A:
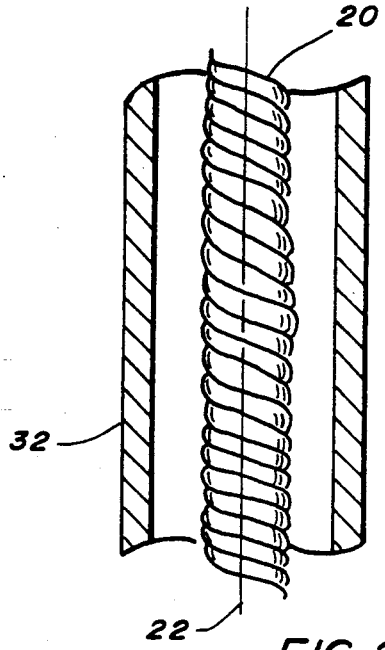
FIG. 2A is a detail taken along line 2A—2A in FIG. 2.
Figure 2B:
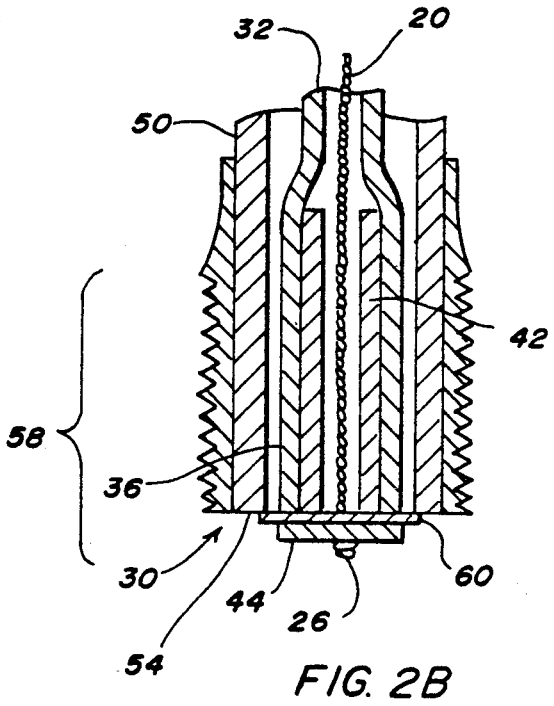
FIG. 2B is a detail taken along line 2B—2B in FIG. 2.

Device 10 includes a first tension spring 20 with a longitudinal coil axis 22 best seen in FIG. 2A. First spring 20 has a fixed end 24 and a free end 26. Free end 26 rotates about coil axis 22 when the spring is axially loaded. Fixed end 24 is attached to a first support 28 that is stopped from rotation and free end 26 is attached to a second support 30 that is free to rotate with the free end. First support 28 is suspended from a ceiling or the like and second support 30 suspends plant 12.

A second tension spring 32 counteracts first spring 20. Second spring 32 is coaxial with first spring 20 but of opposite hand. Second spring 32 has first and second ends 34, 36, respectively. First end 34 of second spring 32 is attached to first spring 20 proximate the fixed end thereof and second end 36 of second spring 32 is attached to first spring 20 proximate its free end.

First and second springs 20, 32, respectively, are formed of materials such that second spring 32 is twisted around coil axis 22 by first spring 20 when the springs are axially loaded. First spring 20 is then twisted around coil axis 22 in the opposite direction by second spring 32 when the springs are axially unloaded.

The tensile strength required in first and second springs 20, 32 depends upon the weight of plant 12 to be supported by device 10. Plants 12 (including the weight of container 14) can vary from a few ounces to 50 pounds or more. The difference in weight between a wet and a dry plant is about 20% when container 14 is made of a light material such as plastic. This is generally true irrespective of the size of the pot or the initial weight of the plant. When container 14 is made of clay or some other heavy material, the difference is less than 20%. The length of first and second springs 20, 32 and the amount that they are stretched must be selected such that a 10-20% change in weight (i.e., change in axial load) is sufficient to induce free end and second end of first and second springs 20, 32, respectively, to twist by at least ½ turn and preferably by one or more turns, first in one direction and then back as the plant goes from wet to dry.

In the embodiment shown in the drawings, second spring 32 is a resilient tube formed of a natural or synthetic rubber substance such as latex, silicon or the like. First spring 20 comprises a strand of resilient material such as a nylon cord which is tightly twisted as shown in FIG. 2A. The radius of the twisted cord is much smaller than the length of first spring 20 to maximize the tendency of free end 26 to rotate about coil axis 22. Illustrative, but not limited to, first and second springs 20, 32 are described in Example 1.

Figure 3:
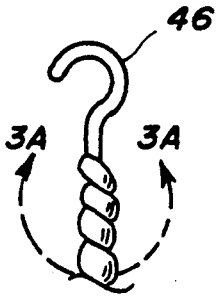
FIG. 3 illustrates another embodiment of the invention.
Figure 3:
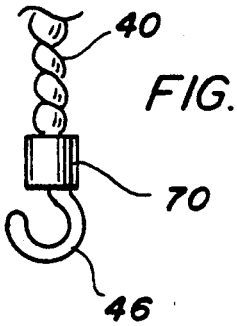
Figure 3A:
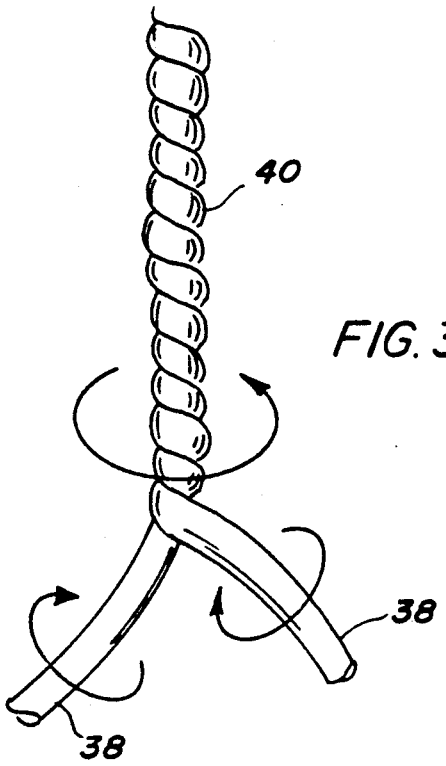
FIG. 3A is a detail taken along line 3A—3A in FIG. 3.

An alternate embodiment is illustrated in FIGS. 3 and 3A. As shown therein, first and second springs 20, 32 are formed from two or more strands 38 of resilient material. Individual strands 38 are twisted in a direction opposite to the direction that strands 38 are twisted into a rope 40.

First support 28 comprises a hollow shank 42 which is headed 44 at one end and is illustrated by a pop rivet. Fixed end 24 of first spring 20 passes through hollow shank 42 and is attached to head 44. First end 34 of second spring 3 is friction fitted over hollow shank 42. A comparable arrangement for attachment of free end 26 of first spring and second end 36 of second spring is provided.

Each of first and second supports 28, 30 has an attachment hook or eye 46. Eye 46 on first support 28 is attached to an overhead surface by a hook that restricts rotation of first support 28. Hook 18 on plant 12 is attached to eye 46 on second support 30. Second support is rotated by first and second springs 20, 32.

In the form shown in the drawings, first and second springs 20, 32 are housed in first and second telescoping sections 48, 50, respectively. Each of sections 48, 50 has an open end 52 and a capped end 54. Sections 48, 50 are hollow and, as illustrated, are cylindrical. Capped end 54 of first section 48 is threaded for receipt of a cooperatively threaded end cap 56 with an attached loop forming hook or an eye 46. A threaded end fitting 58 is friction fitted on capped end 54 of second section 50. A second threaded end cap 56 with an attached loop forming hook or an eye 46 makes threaded attachment with threaded end fitting 58. A washer 60 (one of which is an E snap ring) is provided at the capped end of sections 48, 50. Hollow shank 42 passes through washer 60 and washers 60 serve as an abutment shoulder for supporting head 44 and keeping it from pulling through the telescoped sections.

With no external load applied, first and second springs 20, 32 are longer than first section 48 such that second section 50 is not completely telescoped within first section 48. A wide slip ring 62 is provided on second section 50 for use as a dryness indicator. Slip ring 62 preferably has a band 64 dividing it into upper and lower sections 66, 68, respectively. Upper section 66 may be colored blue or provisioned with other suitable indicia that when visible indicate that plant 12 contains more water than when it was dry and band 64 "zeroed" at open end 52 of first section 48. The outside diameter of slip ring 62 is smaller than the inside diameter of first section 48 such that the slip ring telescopes with the second section into first section 48. To minimize frictional loses, there is a small gap between the outside of slip ring 62 and the inside of first section 48. Instead of slip ring 62, markings 70 (as shown in FIG. 3) may be provided on second support 30, on pot 14 or the like. As second support 30 and pot 14 rotates, the angular position of markings 70 changes, which change can be used by a gardener as an indicia of the moisture content of the soil.

As shown in FIG. 2, caps 56 are removed and first and second sections 48, 50 are telescoped. To assemble device 10, a free end of a cord which will form first spring 20 is attached to head 44 of one of hollow shanks 42 and washer 60 positioned under head 44. First end of second spring 32 is slipped over hollow shank 42 and the cord tightly twisted. The unattached end of springs 20, 32 is then passed through telescoped sections 48, 50. Washer 60 is seated on capped end 54 of first or second section 48, 50 (depending on the direction that the unattached end of the springs is passed through the telescoping sections). The other end of springs 20, 32 is attached to the other one of headed (44) hollow shanks 42. An E washer 60 is snapped under head 44. The E washer is then seated on the other capped end 54. Caps 56 are screwed on threaded capped end 54 of first section 48 and on threaded end fitting 58 of second section 50.

In use, device 10 is hung by eye 46 of first section 48 to a hook (not shown) by which the device is suspended. Eye 46 cannot rotate around the hook and first section 48 is stopped from rotation. A plant 12 in container 14 on lines 16 with hook 18 is hung from eye 46 on second section 50. Springs 20, 32 are of a nature such that a 10–20% change in weight in plant 12 (between wet and dry conditions) is sufficient to cause eye 46 attached to second section 50 to rotate at least ½ turn and preferable one full turn or more.

When a slip ring 62 is provided on second section 50, band 64 is aligned with the terminus of open end 52 of first section 48 when plant 12 is dry. As plant 12 is watered, springs 20, 32 are stretched and upper section 66 of slip ring 62 is made visible. The axial load on springs 20, 32 is gradually lightened as plant 12 dries out and springs 20, 32 shorten. As springs 20, 32 shorten, second section 50 telescopes into first section 48 carrying with it slip ring 62. When band 64 is aligned with open end 52 of first section 48 and upper section 66 (which may be colored blue) is no longer visible, the gardener can easily tell that it is time to water the plant.

As plant 12 thrives, the weight of the plant will increase. As the plant becomes heavier and springs 20, 32 are further stretched, it will be necessary to realign (i.e., "zero") band 64 with the terminus of open end 52 of first section 48 when the plant is dry. This need not be done very often, however, as plant growth is relatively slow even under the optimum watering and rotation program promoted by device 10.

The following example illustrates the invention.

EXAMPLE 1

A 13.25 inch length of NEWTEX latex tubing having an outside diameter of 0.187 inch and an inside diameter of 0.125 inch sold by NewAge Industries of Willow Grove, Pa. was cut for use as second spring 32. An 18 inch length of No. 18 twine sold by Wellington of Madison, Ga. was cut. The twine was tightly twisted so that its length (in the absence of an external load) was substantially the same as the length of the silicon tubing.

A weight was hung on hook 18, data recorded, the weight removed and another weight immediately applied and so forth. The number of turns made by second support 30 were observed. The results are reported in the following table in the order that the data was taken:

TABLE 1

| Weight Applied To Springs 20, 32 In Lbs. | Number of Turns |
|---|---|
| 2½ | 9½ |
| 3 | 12½ |
| 2½ | 12⅜ |
| 3 | 13 1/5 |
| 5 | 27⅜ |
| 10 | 49 |
| 12 | 52¾ |
| 10 | 50½ |
| 12 | 53 15/16 |
| 10 | 51⅛ |
| 12 | 53⅝ |
| 10 | 52½ |
| 12 | 54⅝ |
| 10 | 52½ |
| 12 | 55½ |
| 10 | 52⅝ |
| 12 | 55¼ |

EXAMPLE 2

Device 10 tested in Example 1 was tested again. The results were reported in the following table in the order that the data was taken.

TABLE 2

| Weight Applied To Springs 20, 32 In Lbs. | Number of Turns |
|---|---|
| 0 | 0 |
| 5 | 21½ |
| 6 | 26 |
| 5 | 24 7/8 |
| 6 | 26¾ |
| 5 | 25⅝ |
| 6 | 26 7/8 |
| 5 | 25¾ |
| 6 | 27 1/16 |
| 5 | 25 15/16 |
| 2½ | 17 7/8 |
| 3½ | 18 7/8 |
| 2½ | 17⅛ |
| 3 | 17⅜ |
| 2½ | 17⅛ |
| 4 | 19 3/16 |
| 5 | 22¼ |
| 4 | 21⅜ |
| 5 | 22⅜ |
| 4 | 21½ |
| 5 | 23 1/16 |
| 4 | 22 |

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed is:

1. A device for rotating a hanging plant comprising a first tension spring formed of a tightly twisted resilient cord with a longitudinal coil axis and having a fixed end and a free end that rotates about the coil axis when the first spring is axially loaded, said fixed end attached to a first support for suspension from a ceiling and said free end attached to a second support for suspension of a hanging plant, a second tension spring formed of a resilient tube counteracting the first spring and coaxial with the first spring but of opposite hand, said first end of the second spring attached to the first support and said second end of the second spring attached to the second support, said first spring and said second spring formed of material such that the second spring is twisted around the coil axis by the first spring when the springs are axially loaded and said first spring is twisted about the coil axis in an opposite direction by the second spring when the springs are axially unloaded thereby rotating the second support.

2. The device of claim 1 wherein the second support is rotated by at least ½ turn when the springs are unloaded by a 10 to 20% change in the axial load.

3. A device for rotating a hanging plant comprising a first tension spring with a longitudinal coil axis and having a fixed end and a free end that rotates about the coil axis when the first spring is axially loaded, said fixed end attached to a first support for suspension from a ceiling and said free end attached to a second support for suspension of a hanging plant, a second tension spring counteracting the first spring and coaxial with the first spring but of opposite hand, said first end of the second spring attached to the first support and said second end of the second spring attached to the second support, first and second telescoping sections attached to the first and second supports and surrounding the first and second springs, said first section being shorter than the first and second springs so that the second section is not completely telescoped within the second section, said first spring and said second spring formed of material such that the second spring is twisted around the coil axis by the first spring when the springs are axially loaded and said first spring is twisted about the coil axis in an opposite direction by the second spring when the springs are axially unloaded thereby rotating the second support.

4. The device of claim 3 wherein the first tension spring is a tightly twisted resilient cord and the second spring is a resilient tube.

5. The device of claim 4 wherein the second support is rotated by at least ½ turn when the springs are unloaded by a 10 to 20% change in the axial load.

6. The device of claim 4 wherein a slip ring is provided on the second telescoping section, said ring having a smaller outside diameter than the inside diameter of the first telescoping section such that the slip ring telescopes with the second telescoping section inside the first telescoping section.

7. The device of claim 6 wherein indicia are provided on the slip ring to indicate the moisture content of an attached plant.

* * * * *